US007186993B2

(12) United States Patent
Timpert

(10) Patent No.: US 7,186,993 B2
(45) Date of Patent: Mar. 6, 2007

(54) CONTAINER SYSTEM FOR THE TRANSPORT AND STORAGE OF HIGHLY REACTIVE MATERIALS

(75) Inventor: Friedhelm Timpert, Lüneburg (DE)

(73) Assignee: Polygro Trading AG, Zug (CH)

( * ) Notice: Subject to any disclaimer, the term of this patent is extended or adjusted under 35 U.S.C. 154(b) by 70 days.

(21) Appl. No.: 10/519,902

(22) PCT Filed: Jun. 21, 2003

(86) PCT No.: PCT/DE03/02073

§ 371 (c)(1),
(2), (4) Date: Dec. 27, 2004

(87) PCT Pub. No.: WO04/001766

PCT Pub. Date: Dec. 31, 2003

(65) Prior Publication Data

US 2006/0006351 A1 Jan. 12, 2006

(30) Foreign Application Priority Data

Jun. 25, 2002 (DE) ..... 102 28 387

(51) Int. Cl.
*G21F 5/00* (2006.01)

(52) U.S. Cl. ..... 250/507.1; 250/506.1

(58) Field of Classification Search ..... 250/506.1, 250/507.1

See application file for complete search history.

(56) References Cited

U.S. PATENT DOCUMENTS 4,625,122 A * 11/1986 Botzem et al. ..... 250/506.1
6,166,390 A * 12/2000 Quapp et al. ..... 250/506.1

* cited by examiner

*Primary Examiner*—David Vanore
(74) *Attorney, Agent, or Firm*—Andrew Wilford

(57) ABSTRACT

The invention relates to a container system for the transport and storage of highly reactive materials, which comprises an outer container (1) that encompasses at least one inner container (2) in which the radioactive material is disposed. The inner container (2) is resiliently received in the inner container so as to absorb shocks. The outer container (1) comprises a cylinder (4) whose jacket (5) consists of prestressed reinforced concrete molded by centrifugal action and is provided with a lid (6) and a bottom pate (7) that consist of reinforced concrete. Like the outer container (1), an intermediate container may consist of prestressed reinforced concrete molded by centrifugal action and may encompass the inner container (2). Preferably, the concrete parts of the outer container (1) and the intermediate container (3) are provided with, e.g., boroxyde as an additional neutron absorber. The resilient mounting of the inner container (3) or the intermediate container (3) consists of a plurality of spring elements (10, 11) that encompass, side by side, in the longitudinal direction of the jacket (5) and on all sides thereof, the intermediate container (3) or the inner container (2). The spring elements (10, 11) for their part are provided with shock absorbers.

24 Claims, 7 Drawing Sheets

CONTAINER SYSTEM FOR THE TRANSPORT AND STORAGE OF HIGHLY REACTIVE MATERIALS

CROSS REFERENCE TO RELATED APPLICATIONS

This application is the US national phase of PCT application PCT/DE2003/002073, filed 21 Jun. 2003, published 31 Dec. 2003 as WO 2004/001766, and claiming the priority of German patent application 10228387.7 itself filed 25 Jun. 2002.

BACKGROUND OF THE INVENTION

According to the IAEA Safety Standard Series—Regulations for the Safe Transport of Radioactive Material 1996 Edition Regulations no. TS-R-1 (ST-1 Revised) of the International Atomic Energy Agency, Vienna (German version BfS-ET-31/00) July 2000 salt meshes are subjected to extreme degradation in the so-called Type B casks for transporting and storing highly radioactive materials.

These regulations are revised and set down in detail in English version ST-1. In general there are the following mechanical, thermal, and radiological recommendations:

Nine-meter drop test, pin-drop test, heat test, water-pressure test, as well as handling regulations and regulations regarding reporting of accidents.

According to industry-wide requirements that are based on the world-wide IAEA Regulations and that correspond to the recommendations of the accident-rectifying regulations (according to GGVS/ADR, GGVS/RID, GGVSee/JMDG) the construction of the Type B shipping elements (these are the casks with a radioactive inventory above the limit where their release does not create any increased danger) are based on mechanical, thermal, and radiological tests that ensure the safety of the casks even in severe accidents. They are thus the sole category of safety package where the safety is ensured even in the case of severe accidents.

The mechanical tests for Type B shipping elements, the standard massive heavy vessels, belongs to the nine-meter drop sequence onto a rigid floor and a one-meter drop onto a pin in the position in which the cask is most seriously damaged, which means that for each test there must be a number of drops so that the worst damage for the various parts of the cask can be assessed for each drop. The thermal test following the drop test is a 30-minute burn with complete flame envelopment of the cask by an open fuel-oil flame which heats the entire cask to at least 800° C. These tests set by the IAEA regulations simulate "real" accident situations (prior to 11 Sep. 2001) and have quite a margin of safety.

In mechanical tests it is very important that the cask be dropped on an unyielding floor as this rigidity is not really encountered in real accidents. Since the cask mass is multiplied by the impact deceleration to produce the actual impact force, a nine-meter drop onto a rigid floor produces an impact force that is much higher than that reached in reality on impacting at a much higher speed on a softer floor. This determination as well as the fact that in particular Type B cask that are used for the shipping of spent fuel elements and highly radioactive waste as a result of their massive construction have much greater safety in severe accidents as can be determined by a number of tests.

In addition the Type B cask must comply with radiological requirements. These requirements are also spelled out in ST-1.

Furthermore the container system can be used without this ion shielding for example for other dangerous materials.

What is more, it is essential to take into account what will happen when traveling by train, truck, or boat. Even the analysis of accidents must be done according to the requirements of the IAEA and country-specific requirements.

The known so-called Castor casks do not comply in various ways to the requirements of the IAEA and the applicable German requirements regarding transport and storage.

This type of cask is made by machining as a monolithic object cut from a monolithic block of spherical-graphite cast iron and is provided with separate bores and with machined cooling ribs and are provided to hold spent fuel elements in water in storage pools (wet storage) in which the fuel elements are maintained cool (at least 5 years).

Thus the complete machined but monolithic and thick-walled cask blocks weighing between 100 and 150 t and holding spent fuel elements are completely submerged. The normally brittle surface of the mechanically machined anthracite casting must be given some surface treatment.

Here in the contaminated storage-pool water the spherical-graphite block cask is contaminated inside and outside. As a result it is necessary to meticulously decontaminate the exterior (1998 was the start of a complete handling ban from outside contamination).

The required IAEA drop tests cannot be done with an empty cask. The selected spherical-graphite material does not resist such forces created by mass times acceleration without bursting because of the brittle nature of the material. Trials cannot be made according to the necessary regulations either by calculation (with a substantial margin for error). The actual results can be calculated with models provided with shock absorbers and actually done with Pollux and the so-called Japanese Castor casks.

This testing of the Pollux and Japanese Castor casks, which are provided with large top and bottom shock absorbers only gives results that relate to the shock absorbers and not to the actual strength of the casks.

This results in the following rule: Castor casks with top and bottom shock absorbers must be integrated into form Type B container systems.

The actual spherical-graphite cask is never actually tested. Even the flame test, with 800° C. for at least 30 minutes, is not done. To date there is no reliable data.

OBJECT OF THE INVENTION

It is an object of the present invention to provide a container system of the described type that complies with the above given requirements of the national and international rules and remains undamaged when subjected to the necessary tests, with no release of radioactivity.

SUMMARY OF THE INVENTION

This object is attained according to the invention in that the container system comprises an outer vessel and an inner vessel surrounded by the outer vessel and holding the radioactive material.

This structure has the advantage that all potential damaging from the exterior is completely or nearly completely absorbed by the outer container so that the inner container is itself not affected or is so little affected that there is no damage to the inner container. When sufficiently strong materials are used in spite of any inherent elasticity the outer container can be constructed that even when it is damaged or even destroyed it still generally acts like a sacrificial containment that on its own satisfies the IAEA requirements. Thus the container system can be constructed such that it is used to hold the no longer compliant Castor casks in that they can be put in an outer container according to the invention without head and shock absorbers for safe transport and storage.

BRIEF DESCRIPTION OF THE DRAWING

Further details of the invention are in the following detailed description and the attached drawings in which a preferred embodiment of the invention is shown by way of example. In the drawing.

SPECIFIC DESCRIPTION

Figure 1:
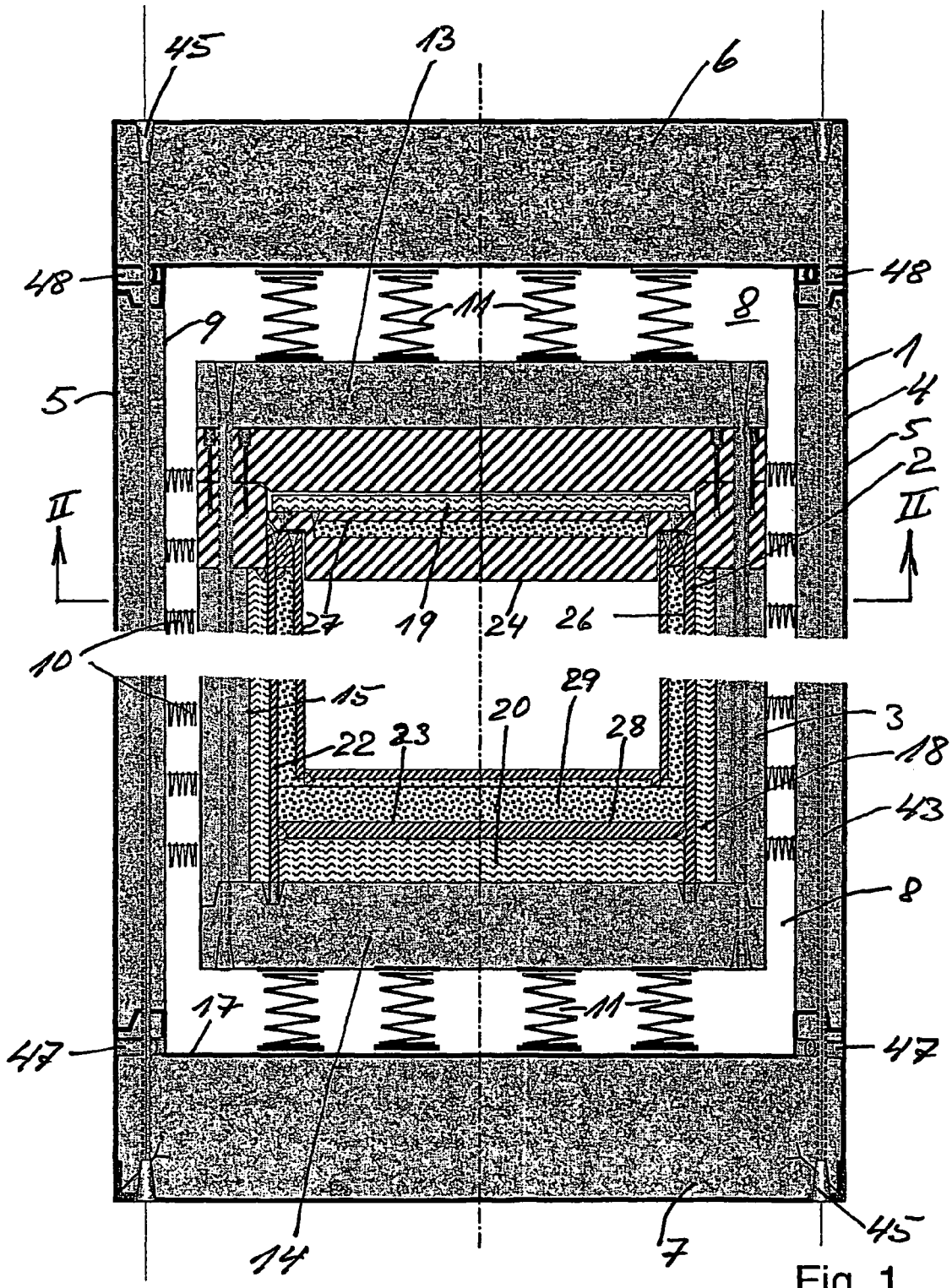
FIG. 1 is a longitudinal section through a container system with an outer container, an intermediate container, and an inner container.
Figure 2:
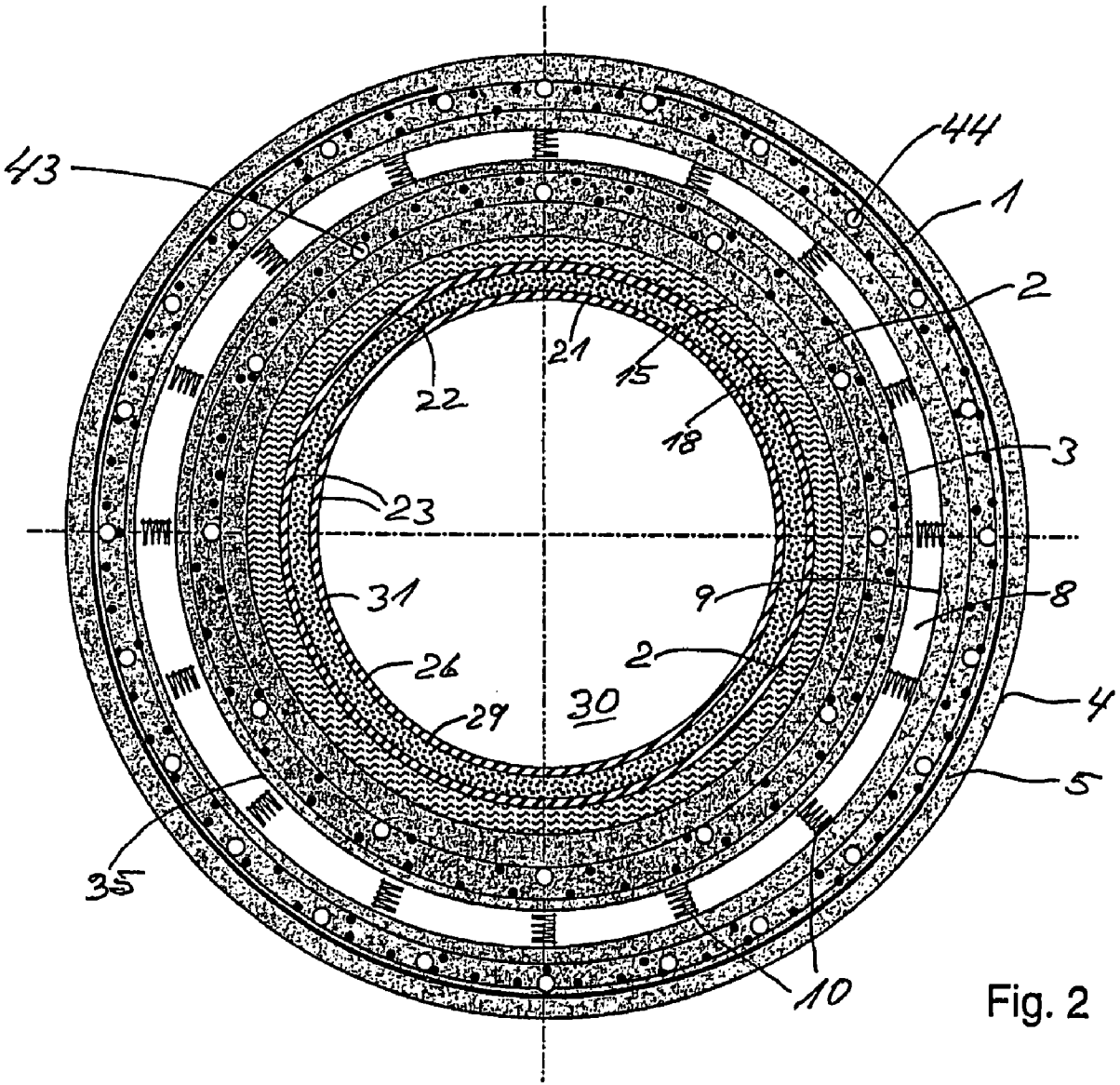
FIG. 2 is a cross section through the container system along line II—II of FIG. 1.
Figure 3:
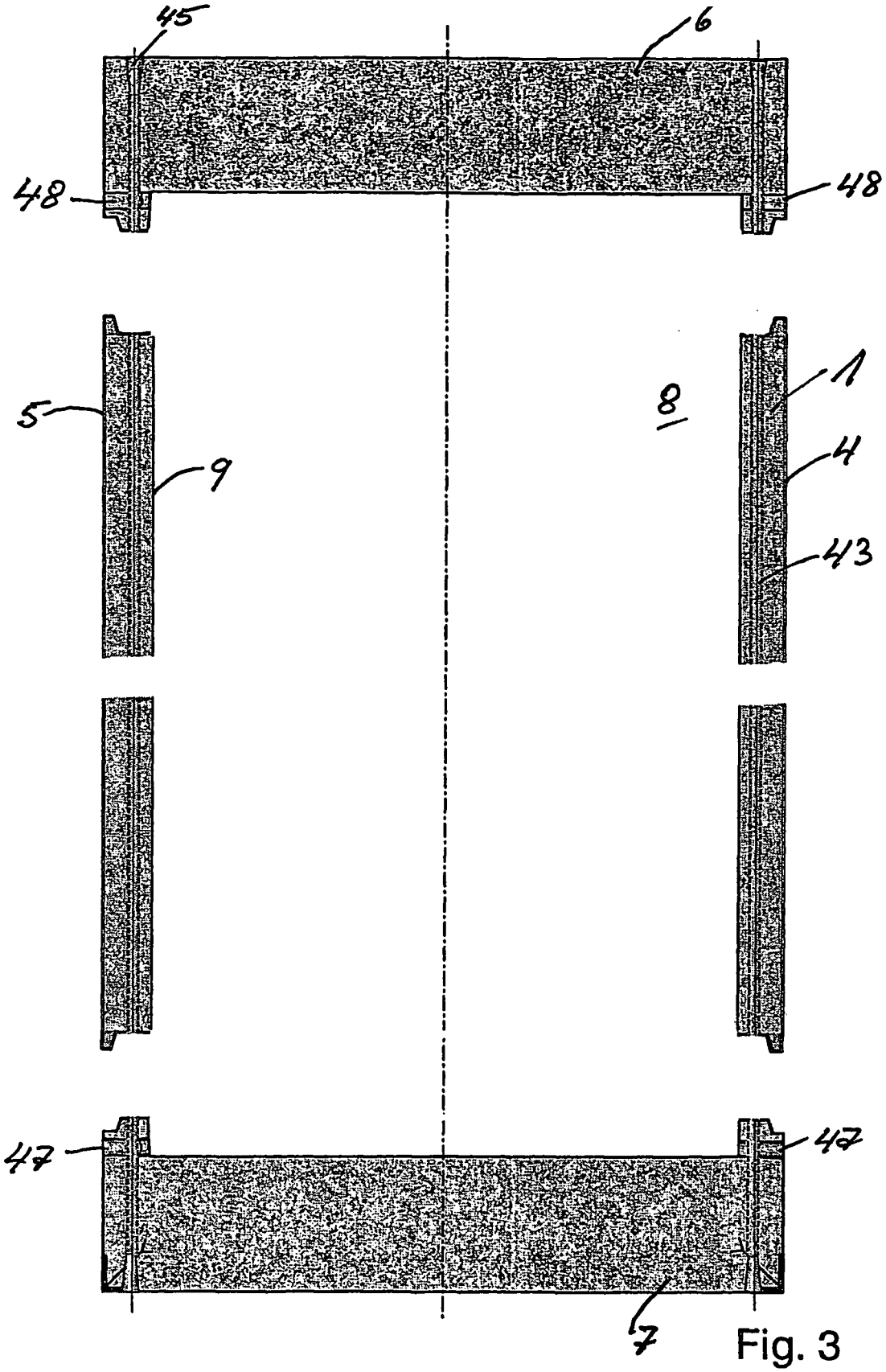
FIG. 3 is a longitudinal section through the outer container in exploded view.
Figure 4:
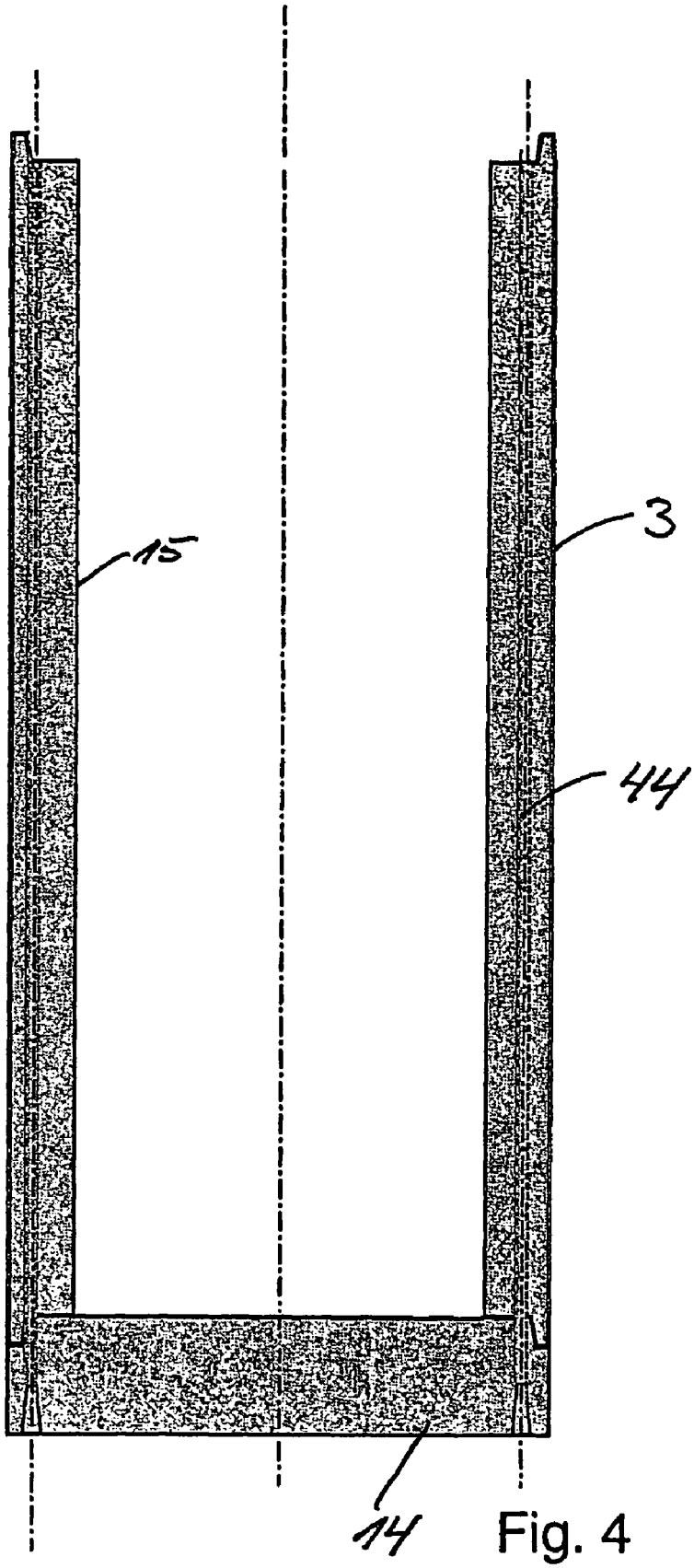
FIG. 4 is a longitudinal section through the intermediate container.
Figure 5:
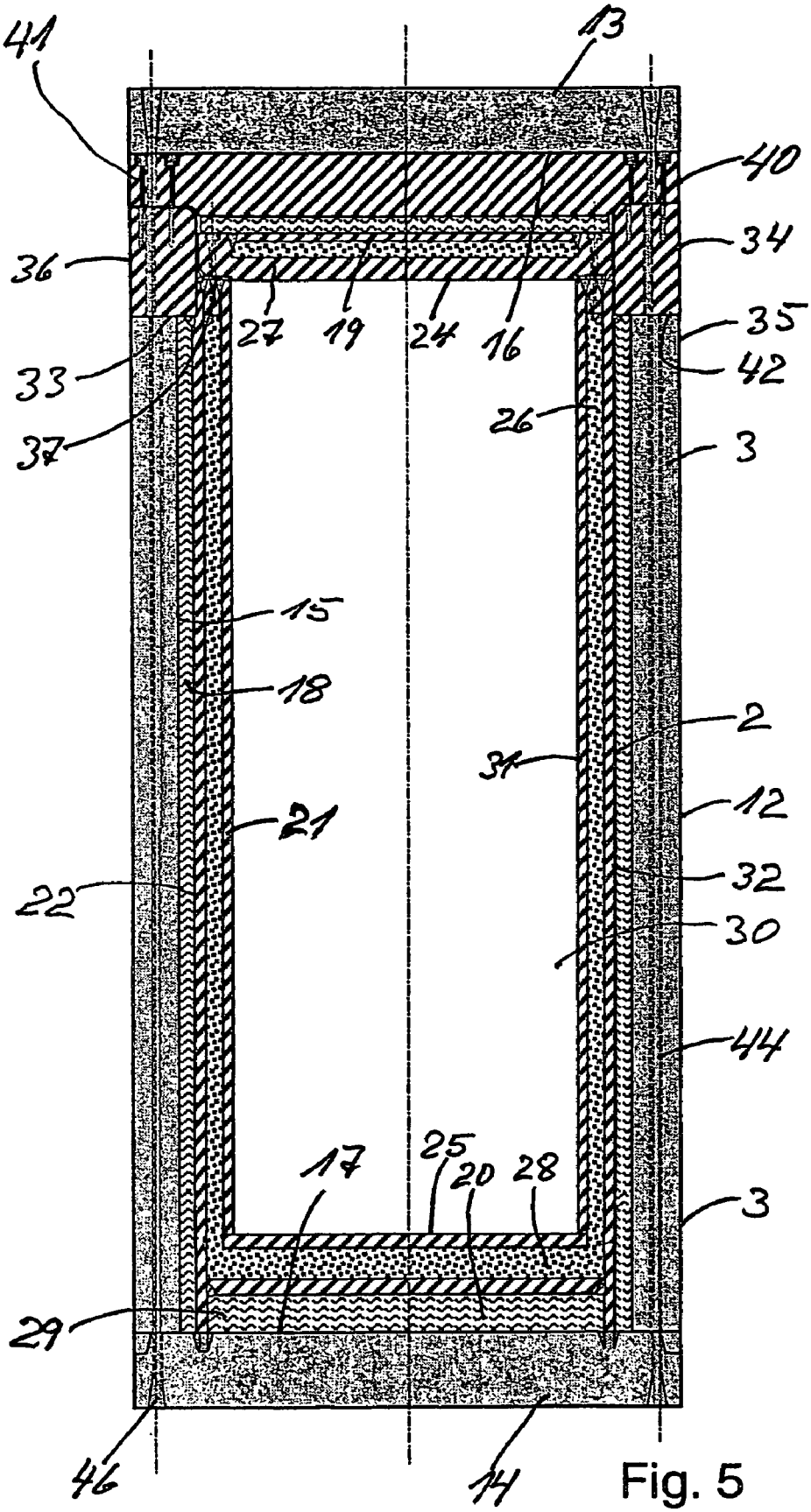
FIG. 5 is a longitudinal section through the middle and inner containers.
Figure 6:
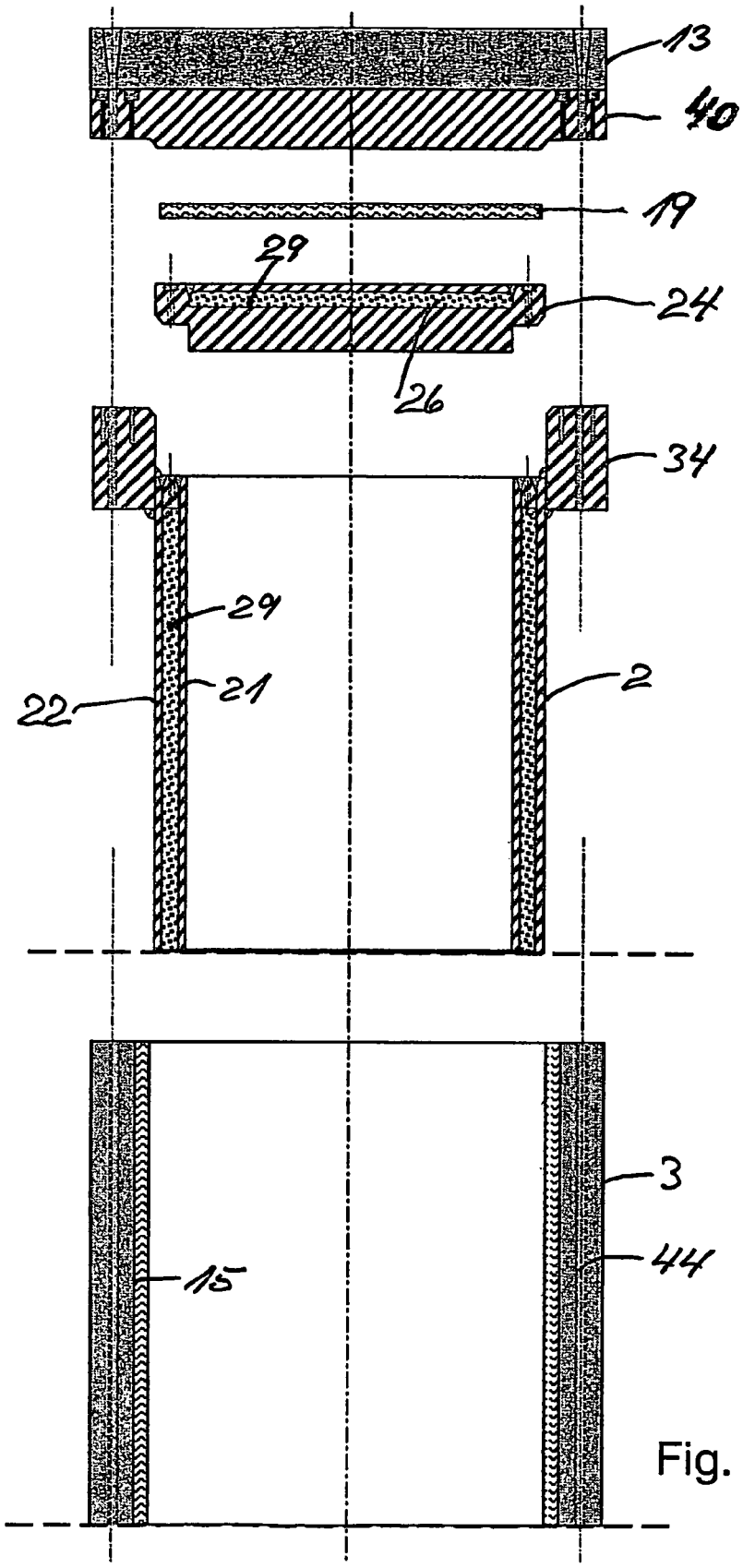
FIG. 6 is longitudinal section through the middle and inner containers in exploded view.
Figure 7:
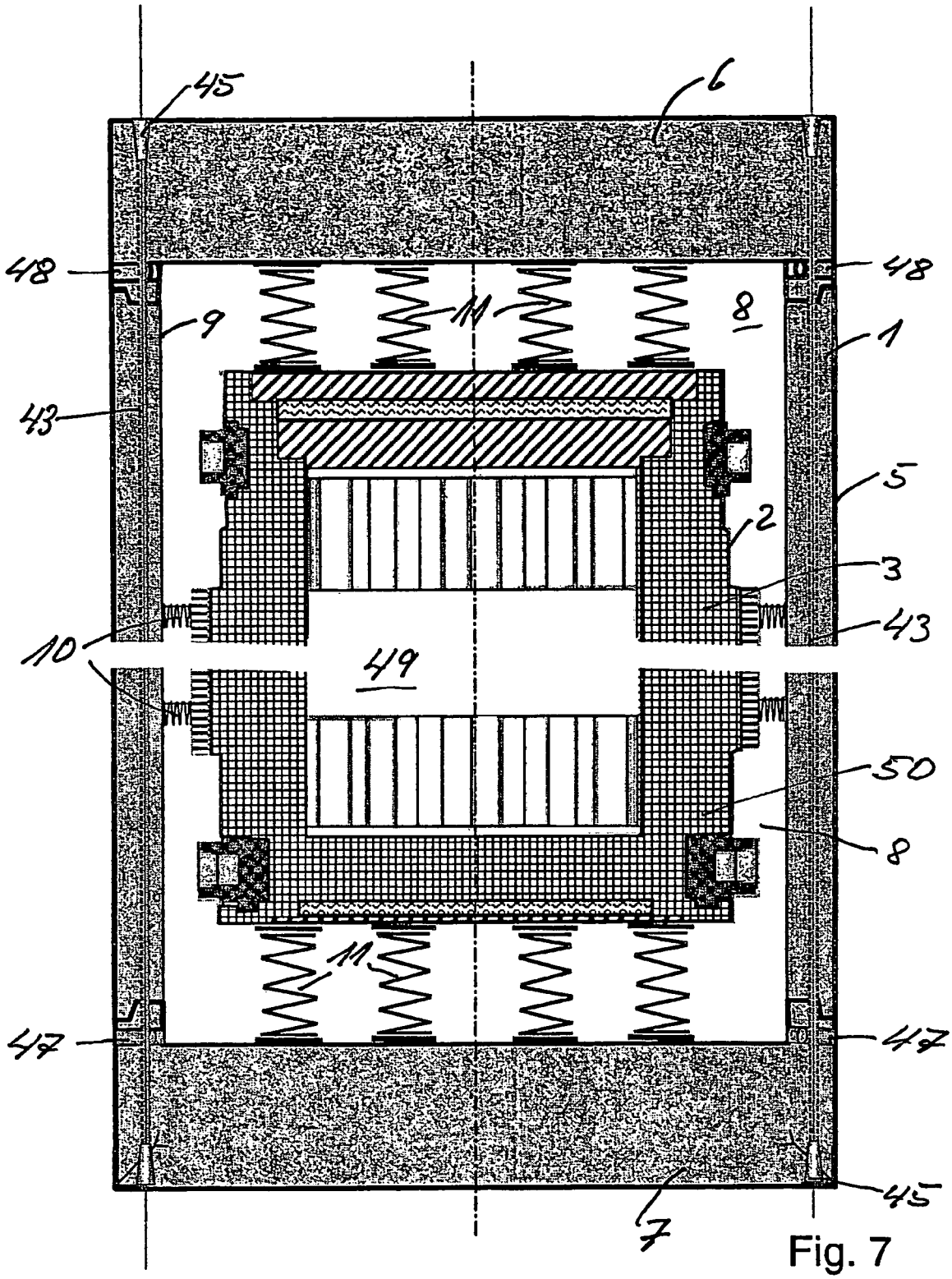
FIG. 7 is a longitudinal section through an outer container inside a standard Castor cask.

A container system according to the invention basically comprises an outer container 1 and an inner container 2 surrounded by an intermediate container 3 inside it.

The outer container 1 comprises a cylinder 4 whose side wall 5 is formed of prestressed reinforced spun concrete. It is further provided with a cover 6 and a floor 7 that are made of reinforced concrete, preferably also of prestressed spun reinforced concrete with boron oxide for additional moderating of neutrons that are present in the radioactive material inside the inner container 2.

The outer container 1 defines a chamber 8 having an inner surface 9 on which are braced springs 10 and 11 also braced on the cover 6 and floor 7. These springs 10 and 11 are preferably provided with (unillustrated) shock absorbers, as for example used in the suspensions of rail cars.

The springs 10 braced against the side wall 5 are distributed about the surfaces 9 to be rotation symmetrical and a plurality of the springs 10 are distributed longitudinally of the side wall 5 next to or one above the other.

The springs 11 braced on the floor 7 and cover 6 are also uniformly arrayed on the cover 6 and floor 7. They have longer travel strokes and greater stiffness than the springs 10 braced against the inner surface 9 of the side wall 5.

Each spring 10 and 11 is provided with an (unillustrated) prestressing device that prestresses it outward against the outer container 1. To this end the prestressing devices can be threaded bolts that extend through the side wall 5, the cover 6, and the floor 7 and engage with an internal thread in a pusher washer against which the respective spring 10 and 11 bears toward the inner chamber 8.

The inner container 2 is wholly inside the intermediate container 3 on whose outer surface 12 and cover 13 and floor 14 bear the springs 10 and 11.

Here the side wall 12 of the intermediate container 3 is made of prestressed spun reinforced concrete. The cover 13 and the floor 14 are also of reinforced concrete, preferably prestressed spun reinforced concrete with boron oxide for additional moderating of neutrons that are emitted by the radioactive materials in the inner container 2.

The intermediate container 3 has on an inner wall surface 15 and on the inner surfaces 16 and 17 of its cover 13 and floor 14 layers 18, 19, and 20 of polyethylene that moderate neutrons that come from the radioactive material in the inner container 2.

The inner container 2 is also a cylinder that is double-walled and of stainless steel. Between the inner wall 21 and the outer wall 22 of its side wall 23, its cover 24, and its floor 25 are spaces 26, 27, and 28 in which a gamma- and neutron-ray shielding absorber 29 is provided. Thus the absorber 29 completely surrounds an inner chamber 30 such that no gamma or neutron ray windows are left. The absorber 29 can be formed of depleted uranium (uranium oxide) or a similarly effective material.

The inner container 2 has a particularly smooth surface finish on inner surfaces of the inner walls 21 and on outer surfaces 32 of the outer walls 22.

The inner container 2 has a surface 33 turned toward the cover 24, and an annular flange 34 that projects above the inner container 2 and that is of such an outer diameter that it conforms to the outer surface 35 of the intermediate container 3 so that the radial outer surface 36 is flush with the outer surface 35 of the intermediate container.

The inner container 2 has adjacent and inside the annular flange 34 a mounting ring 37 that closes an annular gap between the inner wall 21 and the outer wall 22 of the inner container 2. The mounting ring 37 is provided with threaded bores 38 holding mounting bolts 39 that pass through and secure in place the cover 24 of the inner container 2.

Above the cover 24 of the inner container is an intermediate cover 40 that is secured by threaded bolts 41 to the annular flange 34 and that covers with its lower face 42 the adjacent polyethylene layer 13.

The side wall 5, the cover 6, and the floor 7 of the outer container 1 as well as the side wall 12, the cover 13 and the floor 14 of the intermediate container 3 are traversed by empty tubes 43 and 44 in which are arranged mounting elements for prestressing and tightly closing the outer container 1 and the intermediate container 3. The mounting elements 45 and 46 are tie rods.

The outer container 1 is provided near its floor 7 with air-inlet openings 47 and near its cover with air-outlet openings 48 that are distributed radially symmetrically about the side wall 5. The inlet openings 47 and the outlet openings 48 are closable.

Instead of the inner container 2 shown here with the shielding and the intermediate container, the outer container 1 can hold in its inner chamber 8 an industry-standard Castor cask 49 and thereby form a monolithic inner container 50. The Castor ray window is covered in the interior chamber 8 by layers of polyethylene.

The stainless steel used for the inner container 2 is made particularly smooth on both the inner wall 21 and the outer wall 22 so that any contamination can be held as low as possible and so as to facilitate decontamination as much as possible. The inner wall 21 and the outer wall 22 are thus preferably at most 40 mm thick. The absorber 29 in the cavities 26, 27, and 28 is mainly enriched uranium (uranium dioxide) or similar materials that function particularly as gamma- and neutron-ray shield not only because of their mass but because of their properties.

The layers 18, 19, and 29 of polyethylene have the exclusive task of neutron shielding. Unlike the standard casks here there is a closed cask. By putting the inner container 2 in the intermediate container 3 there is a further complete shield container with a unifying corona effect of prestressed reinforced spun concrete, as very clearly described in DE 199 19 703. The use of prestressed reinforced spun concrete produces an extraordinarily strong and stiff but light body that even though of lesser weight has better mechanical properties than spherical-graphite cast iron. Even the shielding is at least as good. In addition prestressed reinforced spun concrete has a highly uniform and smooth surface that does not need to be painted and that is also decontaminated without great expense.

The inner container 2 and the intermediate container 3 have in general all the necessary features to constitute a shipping unit according to the IAEA requirements. In order however to insure that mechanical, thermal, and radiological requirements are met in the required tests (drop test, accident test, burn test), the inner container 2 and the intermediate container 3 are also both made out of prestressed reinforced spun concrete like the outer container 1 that itself is dimensioned such that the inner container 2 and the intermediate container 3 can be fitted inside with room to move.

This is made possible by the prestressed springs 10 and 11 that are braced in all directions on the intermediate container 3. The energy-dissipating travel required by the accurately determined play can be related proportionally from the travels of the springs 10 and 11 and can be transformed into (damped) movements.

The springs 10 and 11 distributed rotation symmetrically about the side wall 5 of the outer container 1 and longitudinally of the outer container 1 are prestressed such that the mass of the inner container 2 with the intermediate container 3 (about 80 t) when horizontal shifts only slightly out of a central position. Even when the outer container 1 is vertical the springs 11 at the cover 6 and the floor 7 are set up such that there is no significant displacement of the inner container 2. The spring prestressing is in any case so great that the weight of the inner container 2 and the intermediate container 3 do not cause a shift.

The container system according to the invention is used as follows:

Once all the springs 10 and 11 are tensioned by their tensioning elements such that they are clear of the side wall 12, cover 13, and floor 14 of the intermediate container 3, it is raised out of the outer container 1. Once the cover 13 of the intermediate container 3, the intermediate cover 40, and the cover 24 of the inner container 2 have been lifted off, the intermediate container 3 is dropped with the inner container 2 into the decay pool and the connection between the inner container 2 and the intermediate container 3 is released such that the inner container 2 can be lifted out of the intermediate container 3 and dropped into another intermediate container 3. This has the advantage that any radioactivity on the first intermediate container does not have to be taken care of, only those regions of the annular flange 34 that are in direct contact in the pool with the radioactive water. In order to fill another inner container, the first intermediate container 3 is fitted with the inner container 2 and dropped into the pool.

After the inner container 2 and the intermediate container 3 are in the chamber 8 of the outer container 1, the cover 6 is closed. Then the springs 10 and 11 are set and released by screwing out the tensioning elements and fitting plugs to the holes that they leave. The outer container that is thus filled with radioactive material emits no radiation at all to the outside due to the several shieldings.

Since spent fuel elements emit heat for a very long time after their use, they pose for a long time a considerable thermal stress to their environs. The result is that the inner container 2 and the intermediate container 3 are at a temperature of 300–500° C.

In order to exploit this energy, the outer container is provided at its floor 7 with air-inlet openings 47 and corresponding air-outlet openings 48 near its cover 6. In this manner thermal action (convection) produces a cooling effect of the intermediate container 3 and the inner container 2 with the passing air being heated so that its heat energy can be exploited after it leaves the outlet openings 48, thereby avoiding the use of an expensive cooling and ventilating system for the storage area holding the container system. Calculations indicate that a heat-energy output of about 20 kw can be counted on from each container system.

Since the intermediate container 3 and the inner container 2 are mounted movably in the outer container 1 by the springs 10 and 11, little heat is transmitted across to the walls of the outer container 1. The air-inlet openings 47 and the air-outlet openings 48 are closable so as fully to closed off the interior 8 of the outer container 1 in the event of a fire or for a submersion test.

The container system protects against any type of mechanical action from outside by the use of the extremely strong materials, the spring suspension, and the mechanical shielding of the radioactive material in the inner container 2 and intermediate container 3. One or more blows struck as a test against the outer container 1 are withstood without substantial damage in particular as they are only affective against its own mass while the inner container 2 and intermediate container 3 are set in damped movement in the inner space 8. This is so effective that the container system can also survive an aircraft accident unscathed. It is so strongly made that it withstands a load drop of 1 t at a deceleration of 300 $m/s^2$. Even the failure of the floor of a storage facility, which resembles an aircraft accident, is survived by the container system. Thus it is possible to use them on the insufficiently stable floors in the Gorleben, Ahaus, and Rugenow storage facilities.

The container system is also safe when completely enveloped by fire. According to the IAEA rules a container must be able to withstand a temperature of 800° C. when enveloped by flames for 30 min. The system according to the invention has withstood a temperature of 1000° C. for 3 hours (New York rule).

Both the inner container 2 and the intermediate container 3 satisfy all radiological requirements, especially for spent fuel rods. The depleted uranium (uranium oxide) and the like have a shielding capacity such that the activity measured outside the inner container 2 is substantially lower than the minimum required level.

The container system is also optimally designed against the effect of armor-piercing-projectiles, as encountered in terrorist acts. An armor-piercing shot fired against the outer container 1 is completely stopped because of its extreme strength. Even if the armor-piercing round makes a small hole in the outer container and a heated-gas high-pressure wave created by the hollow charge enters the chamber 8 of the outer container 1, this gas will uniformly fill the space 8 and act uniformly from outside on the intermediate container 3 and the annular flange 34 of the inner container 2 without damaging either.

The sudden pressurization be relieved through the inlet and outlet openings 47 and 48.

The already described advantages of the container system can also be used in order so as to employ the no longer compliant Castor casks 49. These must otherwise be retired, which is a huge waste in view of the large number already in existence. Here the outer container 1 is made such that it can contain an existing Castor cask and can thus employ the already existing manipulating and storing equipment.

The invention claimed is:

1. A container system for transporting and storing highly radioactive materials, the system comprising:

a cylindrical outer container having a side wall, cover, and floor all made of reinforced concrete with a neutron absorber;

a cylindrical inner container inside the outer container and having a side wall, cover, and floor all made of reinforced concrete with a neutron absorber, the inner container holding the radioactive material; and springs bearing against inner surfaces of the side wall, of the cover, and of the floor of the outer container and bearing on outer surfaces of the side wall, of the cover, and of the floor of the inner container and supporting the inner container in the outer container.

2. The container system according claim 1 wherein the springs bearing on the cover and the floor have a longer spring travel and a higher spring constant than the springs bearing on the side walls.

3. The container system according claim 2 wherein the springs bearing on the side wall have a shorter spring travel and a lower spring constant than the springs bearing on the floors and covers.

4. The container system according claim 3 wherein the springs bearing on the side wall are distributed rotation symmetrically about its inner surface.

5. The container system according claim 4 wherein a plurality of the springs are distributed in a row longitudinally of the side wall.

6. The container system according claim 5 wherein each spring is provided with a prestressing device that prestresses it outwardly toward the outer container.

7. The container system according to claim 6 wherein the prestressing devices are threaded bolts that extend through the side wall, the cover and the floor and engage with an internal thread in a bracing washer that the springs bear inward on.

8. The container system according claim 7 wherein the inner container is generally completely enclosed in an intermediate container having a side wall, a cover and a floor against which the springs are braced.

9. The container system according claim 8 wherein the side wall of the intermediate container is made of prestressed reinforced spun concrete with the addition of an additional neutron absorber.

10. The container system according to claim 9 characterized in that the cover and the floor of the intermediate container is made of reinforced concrete with the addition of an additional neutron absorber.

11. The container system according to claim 9 characterized in that the cover and the floor of the intermediate container are made of prestressed reinforced spun concrete with the addition of an additional neutron absorber.

12. The container system according claim 11, side-wall, cover, and floor inner surfaces of the intermediate container have respective polyethylene layers for moderating neutrons generated by the radioactive material inside the inner container.

13. The container system according claim 12 wherein the inner container is double-walled and has between the inner wall and outer wall of its side wall, of its cover, and of its floor spaces (26, 27, and 28) a gamma- and neutron-ray absorber.

14. The container system according claim 13 wherein the absorber generally fully surrounds an inner chamber of the inner container.

15. The container system according claim 14 wherein the absorber is comprised of depleted uranium or a similarly effective material.

16. The container system according claim 15 wherein the inner container is comprised of stainless steel with contamination-reducing smooth surfaces.

17. The container system according claim 16 wherein the inner container has on an upper surface of its cover an annular flange that projects outward from the inner container and that is of the same outer diameter as an outer surface of the side wall of the intermediate container.

18. The container system according claim 17 wherein the inner container has a mounting ring closing an annular gap between the inside wall and the outer wall at the annular flange and formed with threaded bores receiving mounting bolts that traverse and secure the cover of the inner container.

19. The container system according claim 18 wherein above the cover of the inner container there is an intermediate cover that is secured by threaded bolts to the annular flange and that is covered on its lower face by a layer of polyethylene.

20. The container system according claim 19 wherein the side walls, the covers, and the floor of the outer container and of the intermediate container are provided with longitudinally throughgoing tubes in which are provided mounting elements for prestressing and closing the outer container and the intermediate container.

21. The container system according claim 20 wherein the mounting elements are tie rods.

22. The container system according claim 21 wherein the outer container is provided adjacent its floor with a plurality of air-inlet openings and near its cover with a plurality of air-outlet openings distributed symmetrically over the side wall.

23. The container system according claim 22 wherein the air-inlet openings and the air-outlet openings are closable.

24. The container system according to claim 1, wherein the neutron absorber is boron oxide.

* * * * *